US006260639B1

(12) United States Patent
Yong et al.

(10) Patent No.: US 6,260,639 B1
(45) Date of Patent: Jul. 17, 2001

(54) DRILL BIT INSERTS WITH ZONE OF COMPRESSIVE RESIDUAL STRESS

(75) Inventors: Zhou Yong; S. J. Huang, both of The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/293,372

(22) Filed: Apr. 16, 1999

(51) Int. Cl.[7] ..... E21B 10/46
(52) U.S. Cl. ..... 175/431; 175/432
(58) Field of Search ..... 175/374, 431, 175/432, 434

(56) References Cited

U.S. PATENT DOCUMENTS

| | | | | |
|---|---|---|---|---|
| 4,694,918 | | 9/1987 | Hall | 175/329 |
| 5,351,772 | | 10/1994 | Smith | 175/428 |
| 5,395,680 | | 3/1995 | Santhanam et al. | 428/212 |
| 5,435,403 | | 7/1995 | Tibbitts | 175/432 |
| 5,469,927 | * | 11/1995 | Griffin | 175/432 |
| 5,492,188 | | 2/1996 | Smith et al. | 175/432 |
| 5,566,779 | | 10/1996 | Dennis | 175/426 |
| 5,624,068 | | 4/1997 | Waldenström et al. | 228/262 |
| 5,773,140 | | 6/1998 | Cerutti et al. | 428/332 |
| 5,816,347 | | 10/1998 | Dennis et al. | 175/432 |
| 5,833,021 | | 11/1998 | Mensa-Wilmot et al. | 175/433 |
| 5,871,060 | | 2/1999 | Jensen et al. | 175/420 |
| 5,957,228 | * | 9/1999 | Yortson et al. | 175/431 |
| 5,971,087 | | 10/1999 | Chaves | 175/432 |
| 6,041,875 | * | 3/2000 | Rai et al. | 175/432 |

FOREIGN PATENT DOCUMENTS

| | | | |
|---|---|---|---|
| 9704209 | 2/1997 | (WO) | E21B/10/46 |

* cited by examiner

*Primary Examiner*—William Neuder
(74) *Attorney, Agent, or Firm*—Conley, Rose & Tayon, P.C.

(57) ABSTRACT

A cutter element for use in a drill bit, has a substrate comprising a grip portion and an extension and at least a cutting layer affixed to said substrate. The cutting layer has a cutting surface and an interface surface, and the cutting surface includes a region of residual compressive stress, which functions as a preload or prestress so as to offset the effect of localized loading due to contact with the formation during drilling.

18 Claims, 1 Drawing Sheet

DRILL BIT INSERTS WITH ZONE OF COMPRESSIVE RESIDUAL STRESS

RELATED APPLICATIONS

Not Applicable.

TECHNICAL FIELD OF THE INVENTION

The present invention relates generally to cutting elements for use in earth-boring drill bits and, more specifically, to a means for increasing the life of cutting elements that comprise a layer of superhard material, such as diamond, affixed to a substrate. Still more particularly, the present invention relates to a polycrystalline diamond enhanced insert comprising a supporting substrate and a diamond layer supported thereon, wherein the diamond layer is constructed so as to have a region of compressive prestress on its outer surface.

BACKGROUND OF THE INVENTION

In a typical drilling operation, a drill bit is rotated while being advanced into a soil or rock formation. The formation is cut by cutting elements on the drill bit, and the cuttings are flushed from the borehole by the circulation of drilling fluid that is pumped down through the drill string and flows back toward the top of the borehole in the annulus between the drill string and the borehole wall. The drilling fluid is delivered to the drill bit through a passage in the drill stem and is ejected outwardly through nozzles in the cutting face of the drill bit. The ejected drilling fluid is directed outwardly through the nozzles at high speed to aid in cutting, flush the cuttings and cool the cutter elements.

The present invention is described in terms of cutter elements for roller cone drill bits. In a typical roller cone drill bit, the bit body supports three roller cones that are rotatably mounted on cantilevered shafts, as is well known in the art. Each roller cone in turn supports a plurality of cutting elements, which cut and/or crush the wall or floor of the borehole and thus advance the bit.

Conventional cutting inserts typically have a body consisting of a cylindrical grip portion from which extends a convex protrusion. In order to improve their operational life, these inserts are preferably coated with an ultrahard material such as polycrystalline diamond. The coated cutting layer typically comprises a superhard substance, such as a layer of polycrystalline diamond, thermally stable diamond or any other ultra hard material. The substrate, which supports the coated cutting layer, is normally formed of a hard material such as tungsten carbide (WC). The substrate typically has a body consisting of a cylindrical grip from which extends a convex protrusion. The grip is embedded in and affixed to the roller cone and the protrusion extends outwardly from the surface of the roller cone. The protrusion, for example, may be hemispherical, which is commonly referred to as a semi-round top (SRT), or may be conical, or chisel-shaped, or may form a ridge that is inclined relative to the plane of intersection between the grip and the protrusion. The latter embodiment, along with other non-axisymmetric shapes are becoming more common, as the cutter elements are designed to provide optimal cutting for various formation types and drill bit designs.

The basic techniques for constructing polycrystalline diamond enhanced cutting elements are generally well known and will not be described in detail. They can be summarized as follows: a carbide substrate is formed having a desired surface configuration; the substrate is placed in a mold with a superhard material, such as diamond powder, and subjected to high temperature and pressure, resulting in the formation of a diamond layer bonded to the substrate surface.

Although cutting elements having this configuration have significantly expanded the scope of formations for which drilling with diamond bits is economically viable, the interface between the substrate and the diamond layer continues to limit usage of these cutter elements, as it is prone to failure. Specifically, it is not uncommon for diamond coated inserts to fail during cutting. Failure typically takes one of three common forms, namely spalling/chipping, delamination, and wear. External loads due to contact tend to cause failures such as fracture, spalling, and chipping of the diamond layer. Internal stresses, for example thermal residual stresses resulting from the manufacturing process, tend to cause delamination of the diamond layer, either by cracks initiating along the interface and propagating outward, or by cracks initiating in the diamond layer surface and propagating catastrophically along the interface. Excessively high contact stresses, along with high temperatures and a very hostile downhole environment tend to casue severe wear to the diamond layer.

One explanation for failure resulting from internal stresses is that the interface between the diamond and the substrate is subject to high residual stresses resulting from the manufacturing processes of the cutting element. Specifically, because manufacturing occurs at elevated temperatures, the differing coefficients of thermal expansion of the diamond and substrate material result in thermally-induced stresses as the materials cool down from the manufacturing temperature. These residual stresses tend to be larger when the diamond/substrate interface has a smaller radius of curvature. At the same time, as the radius of curvature of the interface increases, the application of cutting forces due to contact on the cutter element produces larger detrimental stresses at the interface, which can result in delamination. In addition, finite element analysis (FEA) has demonstrated that during cutting, high stresses are localized in both the outer diamond layer and at the diamond/tungsten carbide interface. Finally, localized loading on the surface of the inserts causes rings or zones of tensile stress, which the PCD layer is not capable of handling.

In drilling applications, the cutting elements are subjected to extremes of temperature and heavy loads when the drill bit is in use. It has been found that during drilling, shock waves may rebound from the internal interface between the two layers and interact destructively.

There are three basic modes in the insert failure wear, fatigue and impact cracking. The wear mechanism occurs due to the relative sliding of the PCD relative to the earth formation, and its prominence as a failure mode is related to the abrasiveness of the formation, as well as other factors such as formation hardness or strength, and the amount of relative sliding involved during contact with the formation. The fatigue mechanism involves the progressive propagation of a surface crack, initiated on the PCD layer, into the material below the PCD layer until the crack length is sufficient for spalling or chipping. Lastly, the impact mechanism involves the sudden propagation of a surface crack or internal flaw initiated on the PCD layer, into the material below the PCD layer until the crack length is sufficient for spalling, chipping, or catastrophic failure of the enhanced insert.

The deleterious effect of these mechanisms results in part from tensile stresses that are applied to the insert during drilling. Surface residual stresses are known to have a major affect upon the fatigue and stress corrosion performance of components in service. Tensile residual stresses, which can be developed during manufacturing processes such as grinding, turning, or welding are well known to reduce both fatigue life and increase sensitivity to corrosion-fatigue and stress corrosion cracking in a wide variety of materials. In addition, when tensile stresses are localized, as during impact loading, they can cause or accelerate failure. The diamond layer, while extremely hard and well suited to withstand compressive stress, is brittle and relatively unable to withstand tensile stress. Hence, it is desired to provide a cutting element that is better able to withstand the application of localized tensile loads and provides increased wear resistance and life expectancy without increasing the risk of spalling or delamination.

SUMMARY OF THE INVENTION

The present invention provides a cutting element that is particularly well-suited to withstand the application of localized tensile loads. In order to offset localized tensile loads, the present cutter element includes a region of compressive prestress. The region of compressive prestress is created by deliberating varying the thickness of the diamond layer so that the non-uniform deformation resulting from the manufacturing process creates localized compressive stress. In a preferred embodiment, the region of compressive prestress is centered at the point of impact contact with the formation, and is thus offset from the center or apex of the insert cutting surface. Further in a preferred embodiment, diamond layer is thickest in the vicinity of the region of compressive prestress.

One preferred embodiment of the invention entails applying a cutting layer to a substrate in such a way that the surface of the cutting layer includes a region of residual compressive stress. The substrate/cutting layer interface can include a concave portion if desired. The determination of whether a region of residual compressive stress is formed on the surface of the cutting layer is facilitated by the use of finite element analysis.

BRIEF DESCRIPTION OF THE DRAWINGS

For a detailed description of a preferred embodiment of the invention, reference will now be made to the accompanying Figures, wherein.

DETAILED DESCRIPTION OF THE PREFERRED EMBODIMENTS

Figure 1:
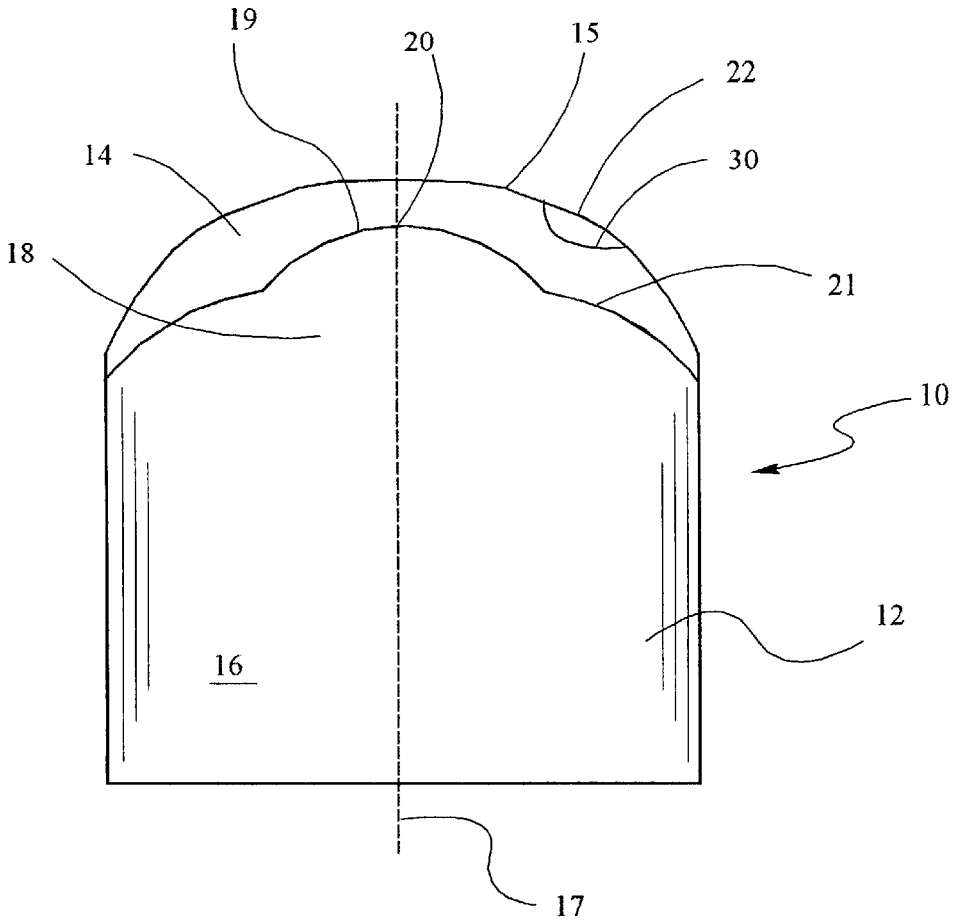
FIG. 1 is cross sectional view of a cutting element constructed in accordance with a preferred embodiment of the invention.

Referring initially to FIG. 1, a cross sectional view of a diamond enhanced insert 10 constructed in accordance with a preferred embodiment of the invention comprises a hard substrate 12, and a cutting layer 14. Substrate 12 comprises a body having a grip portion 16 and an extension portion 18. Grip portion 16 is typically cylindrical, although not necessarily circular in cross-section, and defines a longitudinal insert axis 17. Extension portion 18 includes an interface surface 19, which has an apex 20 and an annular shoulder 21. Cutting layer 14 is affixed to interface surface 19 and includes an outer, cutting surface 15. Cutting layer 14 typically comprises PCD or another ultrahard material. Insert 10 is typically positioned in a drill bit such that the point of contact 22 with the borehole wall does not coincide with axis 17. During drilling operations, a region of localized tensile stress 30 occurs on the surface of cutting layer 14. This tensile stress can cause spalling, cracking or chipping in the cutting layer, and ultimately can cause delamination of the cutting layer According to the present invention, the deleterious effects of the localized tensile loading are mitigated by forming the insert in such a manner that a region of residual compressive stress is formed on the surface of the cutting layer 14. The compressive stress in that region offsets the tensile loading that occurs during drilling. The most appropriate method for inducing compressive stress in the surface of a diamond enhanced insert depends on several factors, including the dimensions and shape of the diamond layer.

According to one embodiment of the present invention, the diamond layer is made thicker in the region where the compressive stress is to be created, with the thickest portion of the diamond layer preferably being centered on the point or surface that contacts the borehole wall during drilling. This point of contact is readily determined by one of ordinary skill in the art and depends on the shape of the insert and the position of the insert in the bit cone. On many inserts, a radius from the point where the axis of the insert intersects the plane between the grip and extending portion of the insert to the point of contact defines an angle of from about 30 to 60 degrees relative to that plane. Besides enabling the formation of a surface region of compressive stress, the region of increased diamond thickness enhances the stiffness of the diamond coating in that area, further improving the performance and life of the insert.

In many instances, increasing the thickness of the diamond layer so as to create a prestress region will result in the interface between the diamond layer and its substrate having a concave portion that coincides with the region of compressive stress. The outer surface, or cutting surface, of the diamond layer may or may not include a concave portion. If it does include a concave portion, the concave portion may or may not coincide with the region of compressive stress.

In addition to increasing the thickness of the diamond layer, the interface between the diamond layer and the transition layer or substrate is carefully shaped so as to maximize the desired effect. One preferred technique for this process comprises using finite element analysis to refine the shape of the diamond interface. More particularly, mathematical and mechanics models are used in an iterative process to optimize the shape of the interface. The resulting interface shape depends on the desired shape of the outer surface and the various properties and manufacturing history of the materials of the cutting layer and so cannot be described with particularity. Nevertheless, the underlying equations that allow optimization of the interface shape are as follows:

$$\sigma_{ij,j}+F_i=\rho\ddot{u}_i, \tag{1}$$

$$\epsilon_{ij}=\tfrac{1}{2}(u_{i,j}+u_{j,i}), \tag{2}$$

$$\sigma_{ij}=\delta_{ij}\lambda\epsilon_{kk}+2\mu\epsilon_{ij}-\delta_{ij}q(T-T_o), \tag{3}$$

and $$hT_{mm}=\rho c_E(dT/dt) \tag{4}$$

where $\sigma_{ij}$ is a stress tensor, $\epsilon_{ij}$ is a strain tensor, $u_i$ is a displacement component, $\ddot{u}_i$ is second derivative of $u_i$ with respect to time, T is the temperature, dT/dt is the first derivative of T with respect to time, F is the body force, and $\delta_{ij}$ is the Kronecker delta. The balance of the symbols, h, ρ, $c_E$, q, $\lambda$, and $\mu$ are physical constants. Various software packages that are capable of using the foregoing equations in combination with finite elements analysis to calculate the stress and strain distributions for a given material set, temperature, geometry, boundaries and load are commercially available and will be recognized by those skilled in the art. Optimizing the shape of the cutting layer can result in a reduction of the tensile contact stress by about 20–40% and can keep residual stresses on the interface at an acceptable level. The maximum thickness of a coating layer can be as high as 0.08 inch for an insert with a 0.44 inch diameter and 0.163 inch extension height. FIG. 1 is an example of an interface that was shaped in this manner.

At a minimum, the residual compressive stress in the diamond layer resulting from the application of the present invention effectively offsets the tensile stresses that might otherwise result from the manufacturing process. This alone improves the life of the inserts. In addition, optimization of the region of compressive stress allows the diamond layer to have, in effect, a prestress region that is better suited to withstand repeated tensile loadings.

The size of the prestress (compressive) region can vary, and is preferably between about 10 and 100 percent of the total area of the outer surface or cutting surface.

It is contemplated that various manufacturing steps could be taken to enhance the effect of the zone of compressive stress. For example, controlling the cooling process of the sintered inserts may allow residual stresses to be maximized.

While the cutter elements of the present invention have been described according to the preferred embodiments, it will be understood that departures can be made from some aspects of the foregoing description without departing from the spirit of the invention. For example, while the outer abrasive cutting surface of the cutting element of this invention is described in terms of a polycrystalline diamond layer or compact, cubic boron nitride or wurtzite boron nitride or a combination of any of these superhard abrasive materials is also useful for the cutting surface or plane of the abrasive cutting element. Likewise, while the preferred substrate material comprises cemented or sintered carbide of one of the Group IVB, VB and VIB metals, which are generally pressed or sintered in the presence of a binder of cobalt, nickel, or iron or the alloys thereof, it will be understood that alternative suitable substrate materials can be used.

What is claimed is:

1. A cutter element for use in a drill bit, comprising:

a substrate comprising a grip portion and an extension; and a cutting layer affixed to said substrate and having a cutting surface and an interface surface, said cutting surface including a region of residual compressive stress wherein said interface surface includes a concave portion that coincides with said region of residual compressive stress.

2. The cutting element according to claim 1 wherein said region of residual compressive stress is located on the portion of the cutting surface that is impact loaded during drilling.

3. The cutting element according to claim 1 wherein said cutting layer is thickest in said region of residual compressive stress.

4. The cutting element according to claim 1 wherein the size of said region of residual compressive stress is between about 10 and 100 percent of the total area of said cutting surface.

5. The cutting element according to claim 1 wherein the size of said region of residual compressive stress is between about 10 and about 90 percent of the total area of said cutting surface.

6. The cutting element according to claim 1 wherein the size of said region of residual compressive stress is between about 10 and 40 percent of the total area of said cutting surface.

7. A cutter element for use in a drill bit, comprising:

a substrate comprising a grip portion and an extension; and a cutting layer affixed to said substrate and having a cutting surface and an interface surface, said cutting surface including a region of residual compressive stress wherein said cutting surface includes a concave portion that coincides with said region of residual compressive stress.

8. The cutting element according to claim 7 wherein said region of residual compressive stress is located on the portion of the cutting surface that is impact loaded during drilling.

9. The cutting element according to claim 7 wherein said cutting layer is thickest in said region of residual compressive stress.

10. The cutting element according to claim 7 wherein the size of said region of residual compressive stress is between about 10 and 100 percent of the total area of said cutting surface.

11. The cutting element according to claim 7 wherein the size of said region of residual compressive stress is between about 10 and about 90 percent of the total area of said cutting surface.

12. The cutting element according to claim 7 wherein the size of said region of residual compressive stress is between about 10 and 40 percent of the total area of said cutting surface.

13. A cutter element for use in a drill bit, comprising:

a substrate comprising a grip portion and an extension; and a cutting layer affixed to said substrate and having a cutting surface and an interface surface, said cutting surface including a region of residual compressive stress that at least offsets the tensile stress induced during manufacture wherein said cutting surface includes a concave portion associated with said region of residual compressive stress.

14. The cutting element according to claim 13 wherein the size of said region of residual compressive stress is about 10 and 100 percent of the total area of said cutting surface.

15. The cutting element according to claim 13 wherein said region of residual compressive stress is located on the portion of the cutting surface that is impact loaded during drilling and wherein said region of residual compressive stress offsets a portion of the tensile stress induced during drilling.

16. The cutting element according to claim 13 wherein said cutting layer is thickest in said region of residual compressive stress.

17. The cutting element according to claim 13 wherein the size of said region of residual compressive stress is between about 10 and about 90 percent of the total area of said cutting surface.

18. The cutting element according to claim 13 wherein the size of said region of residual compressive stress is between about 10 and 40 percent of the total area of said cutting surface.

* * * * *